US005989465A

United States Patent [19]

Säfström et al.

[11] Patent Number: 5,989,465

[45] Date of Patent: Nov. 23, 1999

[54] METHOD OF MANUFACTURING A BOARD

[75] Inventors: Christer Säfström, Stockholm; Stefan Mikaelsson, Hässelby, both of Sweden

[73] Assignee: Sunds Defibrator Industries AB, Sweden

[21] Appl. No.: 09/053,334

[22] Filed: Apr. 1, 1998

[30] Foreign Application Priority Data

Apr. 30, 1997 [SE] Sweden ..... 9701652

[51] Int. Cl.[6] ..... B27N 3/00

[52] U.S. Cl. ..... 264/37.14; 264/37.17; 264/109

[58] Field of Search ..... 264/37.14, 37.17, 264/109, 117, 121, 517, 518

[56] References Cited

U.S. PATENT DOCUMENTS 3,071,822 1/1963 Meiler ..... 264/518
3,630,456 12/1971 Mark ..... 264/37.17
4,311,555 1/1982 Reinhall ..... 162/206
4,517,147 5/1985 Taylor et al. ..... 264/83
5,034,175 7/1991 Safstrom ..... 264/120
5,482,666 1/1996 Larsson .

*Primary Examiner*—Jan H. Silbaugh
*Assistant Examiner*—Stefan Staicovici
*Attorney, Agent, or Firm*—Lerner, David, Littenberg, Krumholz & Mentlik, LLP

[57] ABSTRACT

Methods of manufacturing board products include the steps of drying lignocellulosic material in a first stage dryer, further drying the lignocellulosic material in a second stage dryer, forming the dried lignocellulosic material into a mat, hot pressing the mat, utilizing the pressed air stream from the hot pressing step and a supply of fresh air as the source of drying air for the first and second stage dryers, utilizing the exhaust air from the second stage dryer as a source of drying air for the first stage dryer, and utilizing the exhaust air from the first stage dryer as a source of drying air for the first stage dryer and as a source of combustion air in a furnace.

4 Claims, 2 Drawing Sheets

METHOD OF MANUFACTURING A BOARD

FIELD OF THE INVENTION

The present invention relates to the manufacture of board, such as particle board and fiberboard from lignocellulosic material according to the dry method. More particularly, the present invention relates to such manufacture from raw materials such as wood, straw, bagasse, etc. Still more particularly, the present invention relates to a heat generation system, which is integrated with the manufacture of board and in which contaminating emissions can be eliminated.

BACKGROUND OF THE INVENTION

The manufacture of board of the type mentioned above is carried out by disintegration of the material, gluing, drying and forming into a mat, which is then hot pressed into finished board.

During the manufacture of board material, gaseous organic impurities, such as formaldehyde and other volatile hydrocarbons (VOC, or volatile organic compounds) are generated and emitted. These impurities are primarily emitted from the drying step, but to a certain extent also from the hot pressing step. These substances contribute to the greenhouse effect, and there is an increasingly stronger demand for reducing these emissions. In addition, particulate impurities, in the form of wood dust, are also emitted from the drying, and fly ash is emitted from the heat energy plant.

During the manufacture of board relatively large amounts of heat energy are consumed. The greatest heat consuming steps during the manufacture of MDF (medium density fiberboard) are the defibering process, the drying of the fiber material, and the hot pressing of the fiber mat. In the defibering process steam is used as the heating medium. The fiber dryer and press can be heated with steam, hot oil or hot water.

The fiber dryer can also be heated directly with hot flue gases from a burner in the dryer or from a common heat energy plant. The exhaust air from the drying step also contains fly ash from the flue gases.

With the use of continuous press technology the main portion of the organic substances emitted during the pressing operation can be sucked off with a limited volume of air. The exhaust air can be used as combustion air in the heat energy plant, where the organic impurities are transformed to water vapor and carbon dioxide.

Exhaust air from a dryer, however, has a much larger volume than is the volume of air from a press exhaust by suction. This fact implies that the exhaust air from the dryer cannot simply be used as combustion air in the same way as is the case with the exhaust air from the press. In the case of stringent environmental requirements it can, therefore, be necessary to apply expensive and complicated cleaning technology, for example in the form of gas scrubbers, wet electrostatic precipitators (WESP) or the use of regenerative thermal oxidation (RTO), depending on the requirements of the authorities concerned. These technologies are expensive in terms of both investment and operation costs.

SUMMARY OF THE INVENTION

In accordance with the present invention, a solution to the above problems has now been discovered. According to this invention, a method has been found for manufacturing board product from lignocellose-containing material comprising drying the lignocellulose-containing material in a first dryer stage in the presence of a first supply of drying air to produce a dry lignocellulose-containing material and a first supply of exhaust air, further drying the lignocellulose-containing material in a second dryer stage in the presence of a second supply of drying air to produce a further dried lignocellulose-containing material and a second supply of exhaust air, forming the further dried lignocellulose-containing material into a mat, hot pressing the mat thereby producing a press air stream therefrom, utilizing the press air stream and a supply of fresh air as a source of the first and second supplies of drying air, utilizing the second supply of exhaust air as a source of the first supply of drying air, and utilizing the first supply of exhaust air as a source of the first supply of drying air and as a source of combustion air in a furnace.

In accordance with one embodiment of the method of the present invention, the invention includes producing flue gas from the furnace, and heating the first and second supplies of drying air with the flue gas.

In accordance with another embodiment of the method of the present invention, the method includes reheating the first supply of exhaust air and utilizing the reheated first supply of exhaust air as primary air in the furnace.

In accordance with another embodiment of the method of the present invention, the method includes utilizing at least part of the first supply of exhaust air directly as secondary air in the furnace.

In accordance with this invention, it is therefore possible to minimize the total volume of exhaust air from the hot press and the fiber dryer to a level where this contaminated air can be used up to 100% as combustion air in the heat energy plant. The volatile organic impurities and the wood materials in the dryer exhaust air can thus be combusted in the energy plant furnace in order to form carbon dioxide, water vapor and a small quantity of ash. The ash can be separated in an electrostatic precipitator, before the flue gases are then emitted to the atmosphere.

BRIEF DESCRIPTION OF THE DRAWINGS

The present invention may be more fully appreciated with reference to the following detailed description, which, in turn, refers to the Figures in which.

DETAILED DESCRIPTION

Figure 1:
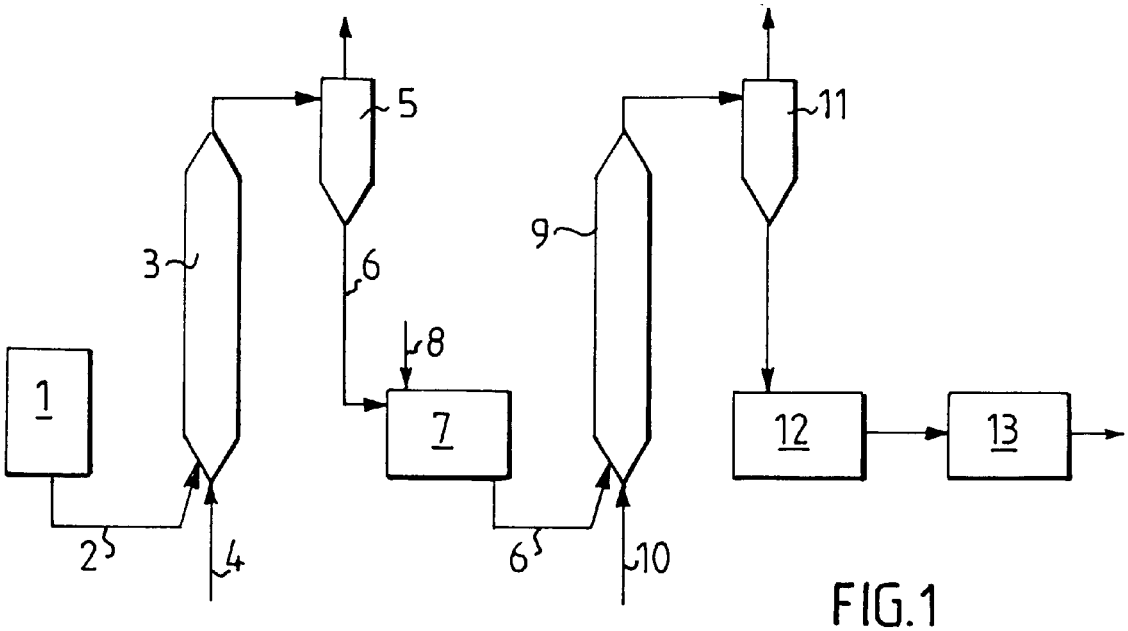
FIG. 1 is a schematic representation of a plant for the manufacture of fiberboard according to the dry method.

Referring to the Figures, the plant shown in FIG. 1 comprises a defibration apparatus 1 for defibering the fiber material. The fiber material is directed from the defibration apparatus 1 through a blow line 2 to a first drying stage 3, for example, in the form of a flash tube-type dryer. Drying of the fiber material takes place while it is simultaneously transported by hot drying air, which is supplied through line 4. After the drying stage 3, the drying air is separated in a first cyclone 5, while the fiber material is moved through line 6 to a mixer 7 for the admixture of hot setting glue, for example urea resin or phenol resin. The glue is supplied through an inlet 8. Alternatively, the glue can be admixed in the blow line before the drying stages.

The glued material is introduced from the mixer 7 to a second drying stage 9, which can be a flash tube-type dryer. The drying takes place while the material is transported by hot drying air, which is supplied through line 10. The material and drying air are transferred from the drying stage 9 to a second cyclone 11, where the gas is separated, and the material is led to a subsequent forming station 12, where the fiber material is formed into a mat, which is then moved to a hot press 13 to be pressed into fiberboard.

Figure 2:
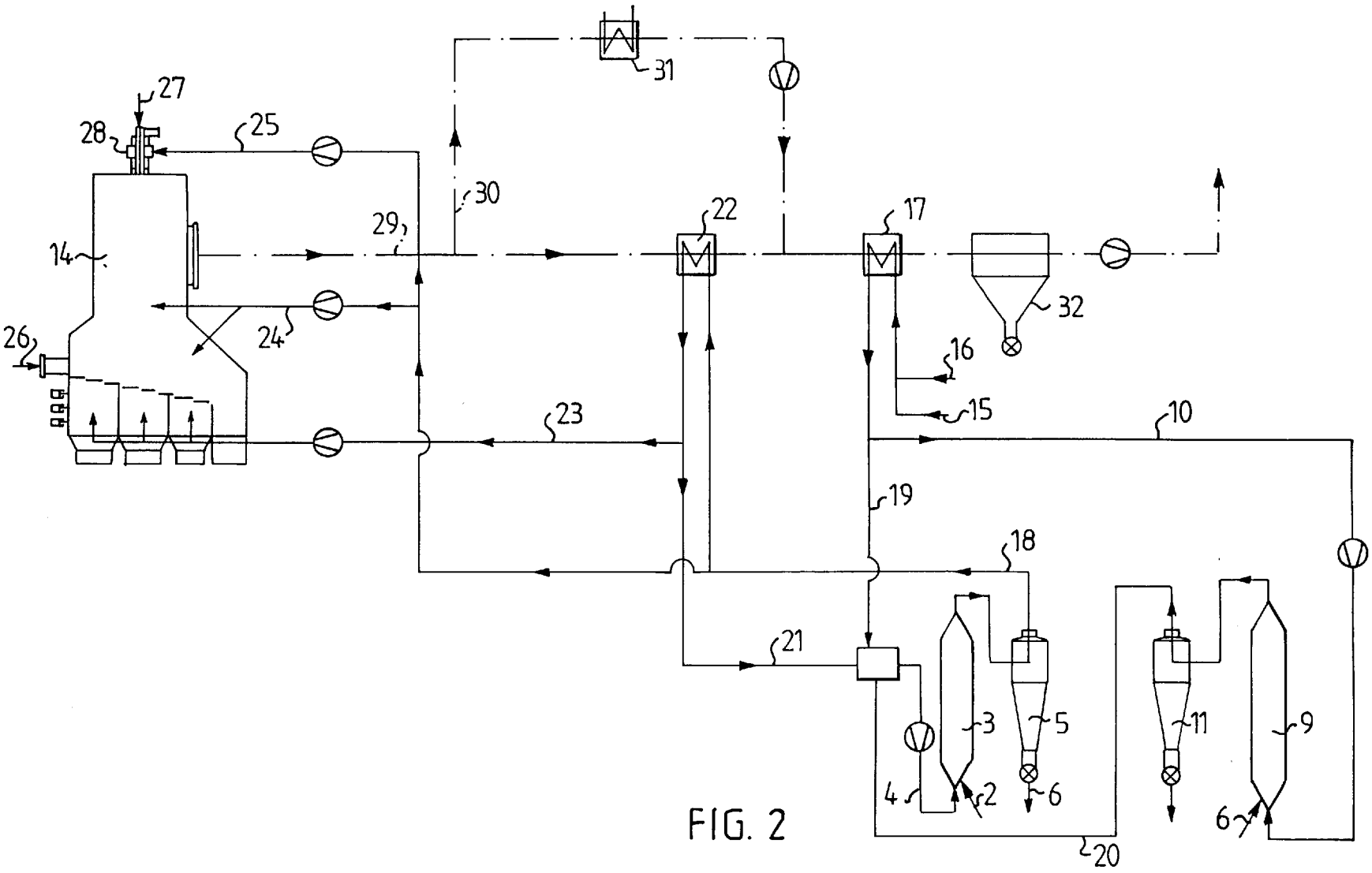
FIG. 2 is a schematic representation and flow diagram showing the use of air and flue gases in a plant for the manufacture of fiberboard according to the present invention.

FIG. 2 schematically shows the flow of drying air and exhaust air, respectively, to and from the drying steps, 3 and 9, through the two cyclones, 5 and 11, and the flue gas flow from a combustion furnace 14 in the heat energy plant.

The air required for drying is supplied in the form of fresh air 15 from the atmosphere, and press air 16 which is supplied from the exhaust of the hot press 13. These two air flows are combined and passed through a first heat exchanger 17 for heating. The main portion of this heated air is directed through a first heat exchanger 17 for heating. The main portion of this heated air is directed through line 10 to the second drying stage 9, while the remaining part is led through line 19 to the first drying stage 3. To the first drying stage 3 are also moved through line 20 exhaust air from the second drying stage, which is separated in the second cyclone 11, and through line 21, recycled preheated exhaust air form the first drying stage. The preheating of this recycled exhaust air takes place in a second heat exchanger 22.

Exhaust air separated form the first drying stage 3 is discharged through line 18. A portion of this exhaust air is directed, after preheating in the heat exchanger 22, through line 23, as primary air to the furnace 14. Another portion of the exhaust air from the first drying stage 3 is moved directly from the cyclone 5 to the furnace 14 as secondary air through lines 24 and 25.

Combustion furnace 14 is formed with an inlet 26 for fuel, which can be biofuel in the form of bark, wood waste, etc., which is generated during manufacture of the board. Sanding dust is suitably supplied through a separate inlet 27 through a dust-burner 29. It is also possible to use oil or gas as additional fuel. Air required for the combustion is supplied, as stated above, through lines 23, 24 and 25.

The flue gases are discharged through line 29, which passes through the two heat exchangers, 17 and 22. By means of branch line 30, from line 29, the flue gases pass through a heat exchanger 31 for other heating purposes, such as for steam generation to the defibering apparatus 1 and/or the heating of thermal oil for the hot press 13.

The heat supplied to the drying stages thus takes place by means of fresh air and press air, which is heated by means of flue gas in heat exchangers. Owing to the fact that flue gases always have a higher moisture content than fresh air, and since even the press air is relatively dry, the introduction of moisture into the drying process is reduced, and therefore the amount of exhaust air can also be reduced.

Due to the fact that drying of the fiber material is carried out in a two-stage fiber dryer with recycling of the dry exhaust air from the second drying stage to the inlet in the first stage the total volume of exhaust air can be reduced by about 35%.

The primary air as well as the secondary air to the furnace can also consist only of exhaust air from the drying steps.

The combustion temperature in the furnace is selected so that the main portion of the volatile, organic substances is combusted, normally at about 850° C. The generated flue gases are cooled in connection with the heat exchange in the heat exchangers, 17, 22 and 31, in order to thereby provide the heat demand for the plant. The flue gases are finally emitted to the atmosphere after dust cleaning in an electrostatic precipitator 32.

The flue gases according to the present system maintain a temperature of about 300° C., which can be compared with 75° C. in a system without air cleaning, where the flue gases are used for direct heating. This implies that the thermal efficiency is reduced to about 70% from about 90%. The difference is the cost of air cleaning in terms of extra heat demand. A thermal efficiency of 70%, however, is comparable to what is achieved in a conventional system with an indirectly heated fiber dryer.

With the system according to the present invention, the entire heat demand can be covered with different types of biofuels. In comparison, it can be mentioned that the aforesaid RTO-technique requires high-quality fuels such as gas or crude oil with low sulfur content.

Another advantage is that, if the evaporation capacity in the dryer is reduced, the degree of recycling in the first drying stage increases. This implies that the thermal efficiency for the entire plant can be held high, even at partial load.

Table 1 below shows expected emissions to the atmosphere for some different alternative heat energy plants.

TABLE 1

| | Gas flow | Particles | | Formaldehyde | | Other VOC | |
|---|---|---|---|---|---|---|---|
| | $Nm^3/hr$ | $mg/Nm^3$ | kg/day | $mg/Nm^3$ | kg/day | $mg/Nm^3$ | kg/day |
| 1 | 346,000 | 50 | 380 | 15 | 115 | 100 | 760 |
| 2 | 22,000 | 45 | 220 | 23 | 110 | 150 | 720 |
| 3 | 220,000 | 15 | 75 | 7 | 35 | 100 | 480 |
| 4 | 220,000 | 10 | 50 | 10 | 50 | 50 | 240 |
| 5 | 220,000 | 10 | 50 | 2 | 10 | 5 | 25 |
| 6 | 110,000 | 50 | 120 | 5 | 12 | 20 | 50 |

(1) Conventional plant with flue gas heated one-stage dryer;
(2) Plant with flue gas heated two-stage dryer with exhaust air recycling;
(3) Same as (2) with gas scrubber;
(4) Same as (2) with wet electrostatic precipitator (WESP);
(5) Same as (2) with regenerative thermal oxidation (RTO);
(6) Plant according to the invention:

The numerical information in Table 1 is based on a fiber capacity of 21 tons per hour, with dry unresinated fiber corresponding to a production capacity of 650 $m^3$ 15 mm MDF per day, at a running time of 22 hrs/day. Regarding the reduction of organic gases in the exhaust air, according to the present invention, substantially the same degree of cleaning is thus achieved as with a regenerative thermal oxidation, but at considerably lower investment and operation costs.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for manufacturing board product from lignocellulose-containing material comprising drying said lignocellulose-containing material in a first dryer stage in the presence of a first supply of drying air to produce a dried lignocellulose-containing material and a first supply of exhaust air, further drying said lignocellulose-containing material in a second dryer stage in the presence of a second supply of drying air to produce a further dried lignocellulose-containing material and a second supply of exhaust air, forming said further dried lignocellulose-containing material into a mat, hot pressing said mat thereby producing a press air stream therefrom, combining and utilizing said press air stream and a supply of fresh air as a source of said first and second supplies of drying air, utilizing said second supply of exhaust air as a source of said first supply of drying air, and utilizing said first supply of exhaust air as a source of said first supply of drying air and as a source combustion air in a furnace.

2. The method of claim 1 including producing flue gas from said furnace, and heating said first and second supplies of drying air with said flue gas.

3. The method of claim 1 including reheating said first supply of exhaust air, and utilizing said reheated first supply of exhaust air as primary air in said furnace.

4. The method of claim 1 including utilizing at least part of said first supply of exhaust air directly as secondary air in said furnace.

* * * * *

UNITED STATES PATENT AND TRADEMARK OFFICE

CERTIFICATE OF CORRECTION

PATENT NO. : 5,989,465

DATED : November 23, 1999

INVENTOR(S) : Säfström et al.

It is certified that error appears in the above-identified patent and that said Letters Patent is hereby corrected as shown below:

On the title page item [57],
line 5, "pressed" should read --press--.

Column 6, line 8, after "source" insert --of--.

Signed and Sealed this

Eighteenth Day of July, 2000

*Attest:*

*Attesting Officer*

Q. TODD DICKINSON

*Director of Patents and Trademarks*